US005086608A

United States Patent [19]

Leubke et al.

[11] Patent Number: 5,086,608

[45] Date of Patent: Feb. 11, 1992

[54] ERGONOMIC HAND LOADING CARTONER BUCKET

[75] Inventors: Emory E. Leubke; Keith R. Haen, both of Appleton, Wis.

[73] Assignee: Kimberly-Clark Corporation, Neenah, Wis.

[21] Appl. No.: 539,103

[22] Filed: Jun. 15, 1990

[51] Int. Cl.[5] ..... B65B 35/30

[52] U.S. Cl. ..... 53/443; 53/542; 53/473; 53/252; 53/390

[58] Field of Search ..... 53/235, 251, 252, 258, 53/259, 390, 391, 473, 475, 542, 393, 578, 579, 443, 531; 198/803.14, 713, 714

[56] References Cited

U.S. PATENT DOCUMENTS

| | | | |
|---|---|---|---|
| 1,456,576 | 5/1923 | Robinson | 53/258 |
| 2,631,767 | 3/1953 | Banks | 53/252 X |
| 3,193,082 | 7/1965 | Crane | 53/391 |
| 3,568,395 | 3/1971 | Docili | 53/258 X |
| 3,608,701 | 9/1971 | Dieter | 53/258 X |
| 3,992,855 | 11/1976 | Palmieri et al. | 198/803.14 X |
| 4,091,601 | 5/1978 | Riggins | 53/390 |
| 4,815,257 | 3/1989 | Hayes, Jr. | 53/433 |

FOREIGN PATENT DOCUMENTS

| | | | |
|---|---|---|---|
| 8400606 | 9/1985 | Netherlands | 53/399 |

*Primary Examiner*—John Sipos
*Attorney, Agent, or Firm*—Gregory E. Croft

[57] ABSTRACT

An ergonomically improved hand loading cartoner bucket is provided with inwardly tapered open side pockets for the operator's hand(s) which are sized such that the product being placed into the bucket cannot shift to the side. Such cartoner buckets provide the operator with greater ease of access during loading and therefore improved overall efficiency.

9 Claims, 2 Drawing Sheets

ERGONOMIC HAND LOADING CARTONER BUCKET

BACKGROUND

In the manufacture of products such as dinner napkins, individual stacks of napkins are inserted into cartons which are then closed and sealed. The cartons of napkins are then boxed and shipped to customers. During this cartoning process, each stack of napkins to be cartoned is manually transferred from a folder discharge chute into a cartoner "bucket". The bucket then moves to a station where the stack of napkins is transferred mechanically into an open carton, usually by a ram which enters one end of the bucket and pushes the stack out the other end. The design of the bucket is such that the stack of napkins is snugly held in place so that it is properly oriented for transfer into the carton. Because the bucket is designed to hold the stack of napkins in this manner, there is little or no room for the operators' hand when placing the napkin stack into the bucket. This can cause the operator to sometimes improperly place the napkin stack within the bucket or possibly scrape some knuckles during the course of a shift.

SUMMARY OF THE INVENTION

In one aspect, the invention resides in an improved hand-loading cartoner infeed bucket comprising two sidewalls, an open top for receiving product, a bottom for supporting the product, an open end through which the product is loaded into a carton, wherein at least one sidewall has an open indentation sufficiently large to accept a hand, the length of the opening of said indentations being less than the length of the product to be inserted into the bucket. Although the bucket of this invention is particularly suited for handling stacks of dinner napkins, it is also suitable for use with any other product which is placed into a container during manufacturing or assembly.

In another aspect, the invention resides in an improved method for cartoning a product in which a product is hand-loaded into a bucket having an open top, a bottom, two sidewalls, an open end, and means for sliding the product out through the open end into a carton, the improvement comprising inserting the product into the bucket such that one or both hands are inserted into an indentation in the sidewall of the bucket, wherein said indentation does not interfere with alignment of the tissue within the bucket.

DETAILED DESCRIPTION OF THE DRAWING

Figure 1:
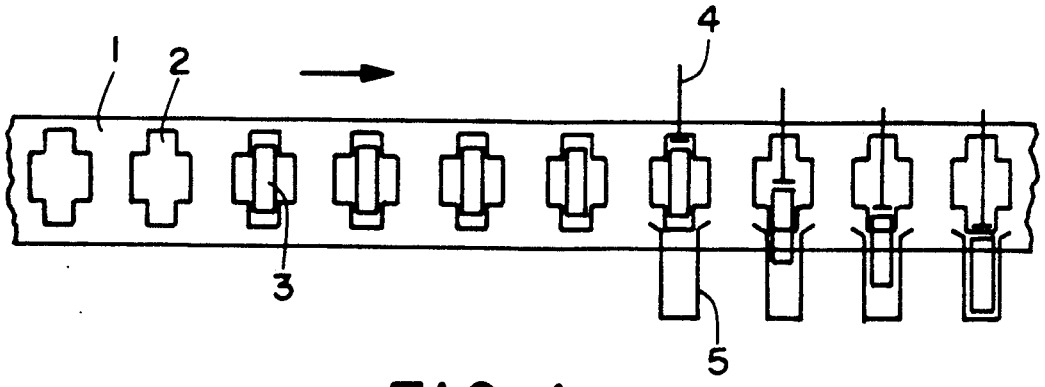
FIG. 1 is a schematic view of a carton loading process in which the cartoner bucket of this invention can be used.

Referring now to the drawing, the invention will be described in greater detail. FIG. 1 represents a schematic view of a carton loading process using cartoner buckets in accordance with this invention. Shown is a chain conveyor 1 containing a plurality of cartoner buckets 2 into which an operator places product 3, such as a stack of dinner napkins. The arrow indicates the direction of travel of the chain conveyor. As the loaded cartoner buckets reach the end of the process, a means 4 for sliding the product out the other end into an awaiting open carton 5 is provided in the form of a ram. After the carton is filled, the ram retracts and the chain returns the now empty bucket to the beginning of the process to be filled again.

Figure 2:
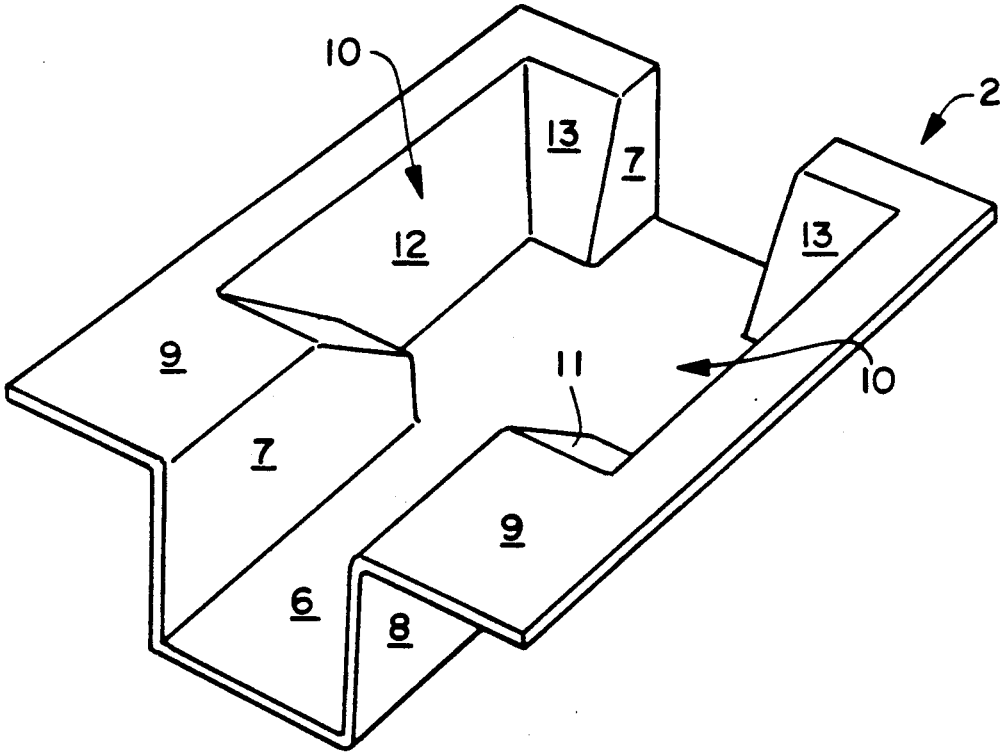
FIG. 2 is a perspective view of a cartoner bucket designed in accordance with this invention.

FIG. 2 shows a perspective view of a cartoner bucket in accordance with this invention. The bucket 2 in general consists of a U-shaped trough having a bottom 6, two sidewalls 7 and 8, an open top for receiving product surrounded by a top surface 9, and two open ends. One of the open ends allows the ram to enter the bucket while the other open end allows the product to be pushed out of the bucket. The sidewalls are provided with an two open indentations 10 sufficiently large to accept the operator's hand while placing the product into the bucket. Having such open indentations in both sidewalls permit the operator to use both hands or either the right or left hand, whichever is preferred. An important aspect of the design is the presence of an inward taper at the uppermost portion of the indentation(s) to allow the operator's hand(s) to access the bucket with ease at an angle. As shown, both indentations comprise three sidewalls 11,12, and 13, all of which have an inward taper or bevel, thus allowing the operator to more easily insert product from the ends and from the sides.

Figure 3:
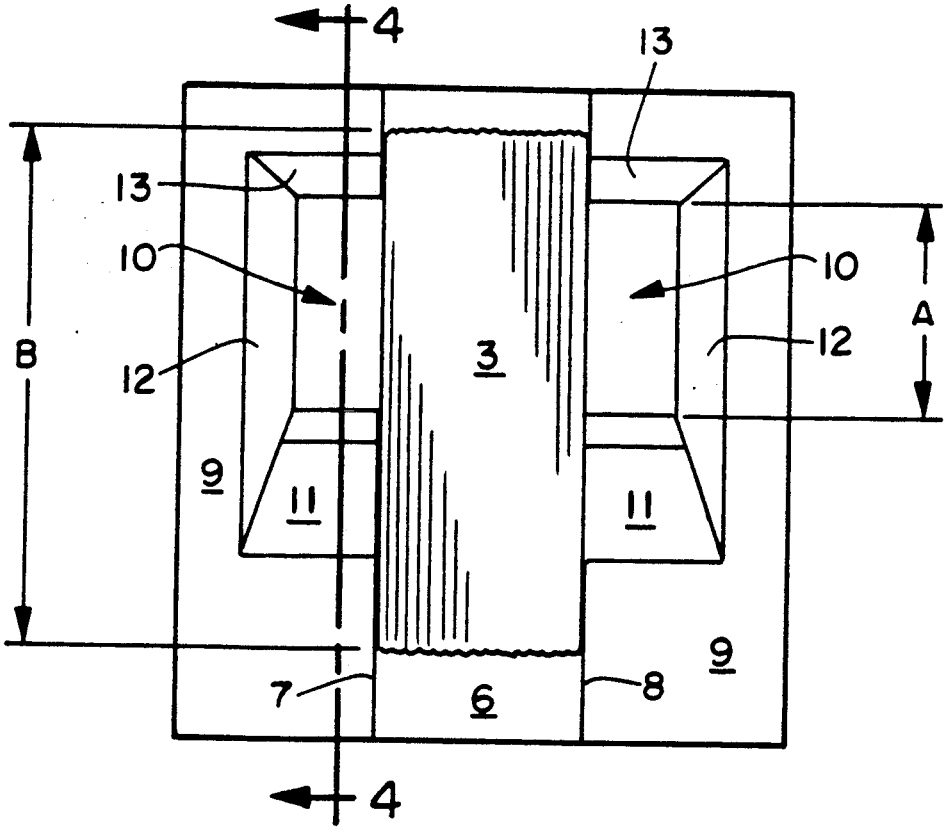
FIG. 3 is a top view of the cartoner bucket of FIG. 2.

FIG. 3 shows a top view of the bucket of FIG. 2, illustrating the position of the product 3 after it has been placed into the bucket. Note that the spacing of the sidewalls 7 and 8 is just wide enough to accommodate the product, yet narrow enough to sufficiently constrain the product to keep it in alignment for subsequent cartoning. Also note that the length of the indentations at the bottom of the bucket, denoted by "A", is less than the length of the product, which is denoted by "B". This relationship prevents the product from being skewed inside the bucket, which could cause difficulties in transferring the product to the carton.

Figure 4:
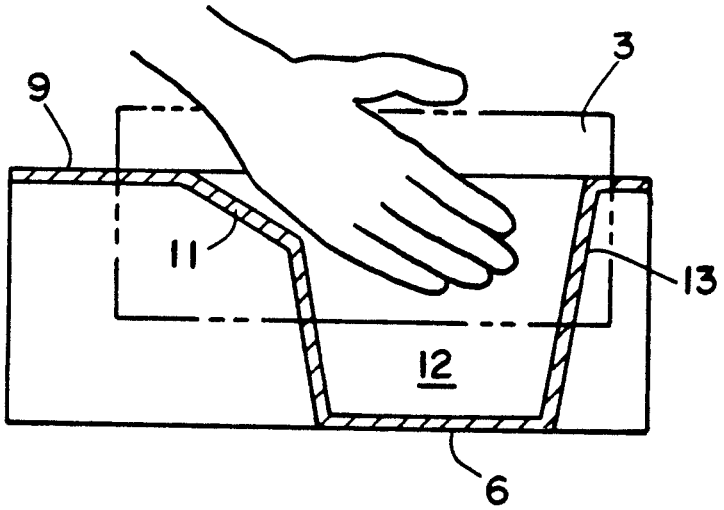
FIG. 4 is a sectional side view of the cartoner bucket of FIG. 2.

FIG. 4 is a sectional side view of the bucket of FIG. 2, further illustrating the placement of an operator's hand into the bucket during loading.

It will be appreciated that the foregoing description, given for purposes of illustration, is not to be narrowly construed to limit the scope of the invention, which is defined by the following claims.

We claim:

1. A hand-loading cartoner infeed bucket comprising an open top, a bottom and at least one open end for sliding product into an open carton, said bucket further comprising two sidewalls, at least one of said sidewalls having an open indentation sufficiently large to accept a hand and which provides a discontinuity in the mating surface between the bottom and the sidewall, wherein the length of the discontinuity is less than the length of the product to be placed in the bucket.

2. The bucket of claim 1 wherein both sidewalls have an indentation.

3. The bucket of claim 1 wherein an upper portion of the indentation is inwardly tapered.

4. The bucket of claim 1 wherein the indentation consists of three sidewalls, two of which are inwardly tapered.

5. A hand-loading cartoner in-feed bucket comprising two sidewalls spaced apart sufficiently to accept and guide product, an open top for receiving product, a bottom for supporting product, at least one open end through which product is loaded with a carton, wherein both sidewalls have an open indentation sufficiently large to accept a hand and which provides a discontinuity in the mating surface between the bottom and the sidewall, the length of the discontinuity less than the length of the product to be inserted into the bucket, said indentation having inwardly tapered sides for easier hand access and removal.

6. In a method for cartoning a stack of napkins in which a stack of napkins is hand-loaded into a bucket having an open top, a bottom, two sidewalls, an open end, and means for sliding the stack of napkins out through the open end into a carton, the improvement comprising providing said bucket with an indentation in a sidewall of the bucket which provides a discontinuity in the mating surface between the bottom and the sidewall, wherein said discontinuity does not interfere with alignment of the napkins within the bucket and inserting the stack of napkins into the bucket such that one or both hands are inserted into an indentation.

7. The method of claim 6 wherein the stack of napkins is inserted into the bucket with the right hand.

8. The method of claim 6 wherein the stack of napkins is inserted into the bucket with the left hand.

9. The method of claim 6 wherein the stack of napkins is inserted into the bucket with both hands.

* * * * *